United States Patent [19]

Hentschel et al.

[11] Patent Number: 4,854,776

[45] Date of Patent: Aug. 8, 1989

[54] PROCESS AND APPARATUS FOR LINING A TUNNEL WITH CONCRETE

[75] Inventors: Volker Hentschel, Hildesheim-Itzum; Clemens Versteegen, Essen; Olaf Mahmens, Essen-Heisingen; Siegmund Babendererde, Lübeck-Travemünde, all of Fed. Rep. of Germany

[73] Assignee: Hochtief Aktiengesellschaft Vorm. Gebr. Helfmann, Essen, Fed. Rep. of Germany

[21] Appl. No.: 218,240

[22] Filed: Jul. 12, 1988

[30] Foreign Application Priority Data

Jul. 17, 1987 [DE] Fed. Rep. of Germany ..... 3723625

[51] Int. Cl.[4] ..... E21D 9/06; E21D 11/00

[52] U.S. Cl. ..... 405/147; 405/141; 405/146; 405/150

[58] Field of Search ..... 405/146, 141, 143, 150

[56] References Cited

U.S. PATENT DOCUMENTS

| | | | |
|---|---|---|---|
| 4,391,553 | 7/1983 | Weirich et al. | 405/141 |
| 4,621,947 | 11/1986 | Babendererde et al. | 405/146 |
| 4,729,693 | 3/1988 | Hentschel | 405/144 |
| 4,768,898 | 9/1988 | Babendererde et al. | 405/150 |
| 4,769,192 | 9/1988 | Cerutti | 405/146 X |
| 4,798,267 | 12/1988 | Babendererde et al. | 405/150 X |

FOREIGN PATENT DOCUMENTS

| | | |
|---|---|---|
| 2913091 | 10/1980 | Fed. Rep. of Germany . |
| 2932430 | 2/1981 | Fed. Rep. of Germany . |
| 3127311 | 2/1983 | Fed. Rep. of Germany . |
| 3406980 | 4/1985 | Fed. Rep. of Germany . |

*Primary Examiner*—Randolph A. Reese
*Assistant Examiner*—Arlen L. Olsen
*Attorney, Agent, or Firm*—Herbert Dubno

[57] ABSTRACT

A process for lining a tunnel with concrete behind a tunnel excavator having a for front advanced along with an excavator head in which the concrete is forced between the surrounding subterranean geological structure and an inner tunnel-lining form through a form front which rides sealingly on the outer surface of the inner tunnel-lining form and on the inner surface of the shield. Simultaneously, the form front, which is longitudinally movable relative to the shield, moves forward relative to the inner tunnel-lining form. The form front is movable forward simultaneously balancing the friction forces occurring between the form front and the shield and the inner tunnel-lining form. Satisfactory results are obtained when the friction forces between concrete sections of a predetermined length are measured by moving the form front relative to the stationary shield and the inner tunnel-lining form during an interruption in concrete feed. An apparatus for carrying out the process includes a hydraulic spring device attached between the form front and the shield which is a part of a control loop having a control device connected to the concrete pump. The hydraulic cylinder device can comprise a plurality of double-cylinder piston-cylinder devices.

5 Claims, 1 Drawing Sheet

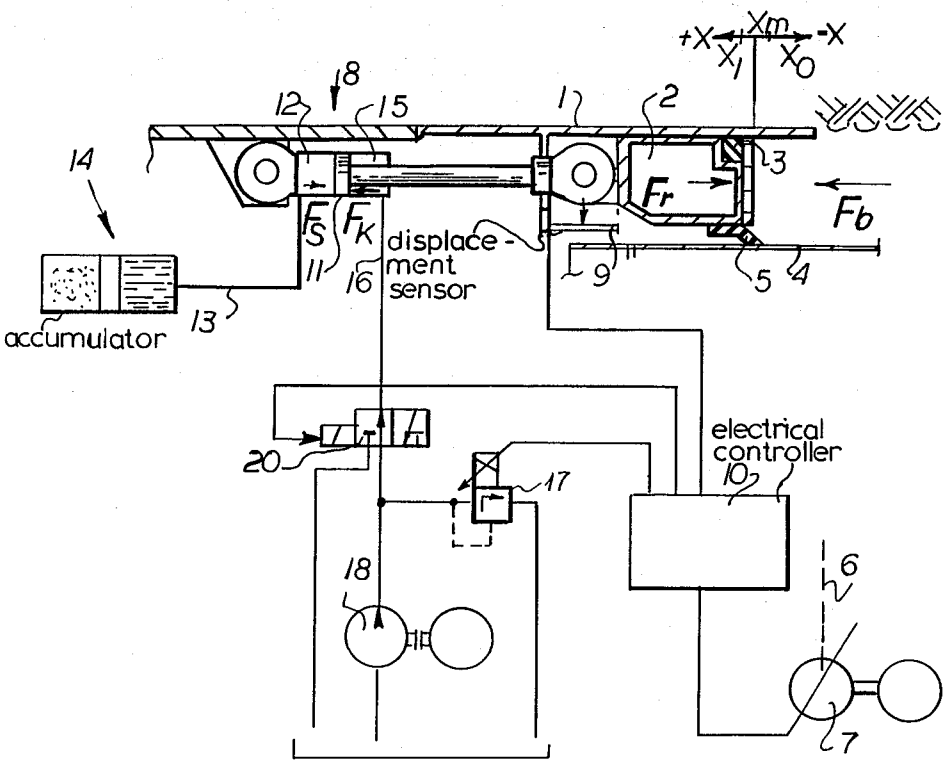
+X
-X
Xm
X0
X1
Fb
Fr
FK
FS
displace-
ment
sensor
electrical
controller
accumulator
1
2
3
4
5
6
7
8
9
10
11
12
13
14
15
16
17
18
20

PROCESS AND APPARATUS FOR LINING A TUNNEL WITH CONCRETE

CROSS REFERENCE TO RELATED APPLICATIONS

This application is related to the copending applications: Ser. Nos. 07/032,334 filed Mar. 30, 1987 (U.S. Pat. No. 4,785,559); 07/061,864, filed June 11, 1987 (U.S. Pat. No. 4,768,898); 07/129,655, filed Dec. 7, 1987; 07/157,848, filed Feb. 18, 1988 and 07/175,191, filed Mar. 30, 1988.

FIELD OF THE INVENTION

Our present invention relates to a process and apparatus for making a concrete tunnel lining.

BACKGROUND OF THE INVENTION

A tunnel can be lined with concrete behind a tunnel excavator having a shield advanced with the excavator head in which the concrete is forced between the surrounding subterranean geological structure and the inner tunnel-lining form through a form front which rides sealingly on the outer surface of an inner tunnel-lining form and on the inner surface of the shield.

The form front moves forward relative to the inner tunnel-lining form longitudinally and generally also relative to the shield. The form front is thus movable forward simultaneously with concrete feed behind the form front, balancing the friction forces between the form front and the shield and the inner tunnel-lining form.

An apparatus for carrying out this process is known in which the form front has an outer seal contacting on the inner surface of the shield and an inner seal contacting on the outer surface of the inner tunnel-lining form, is provided with a movable concrete feed hose connected to a concrete pump, and is provided with an adjustable hydraulic spring device balancing the friction forces. A displacement measuring device which is an input element of a control device is associated with the form front and the shield.

Among the known features of this process as described in German Pat. No. 34 06 980 is in particular an adjustment of the hydraulic spring device.

A control device acts only to keep the form front within a predetermined distance from the shield or excavator head, has a piston-cylinder device by which the shield is coupled to a drive unit of the tunnel excavator, and has a concrete pump as a control element.

These features do not meet the requirements of the process. Experience with tunnel excavators in the diameter range of 6 to 7 meters has shown that the required balancing forces can fluctuate between 400 and 1400 kN. This leads to correspondingly large fluctuations of the concrete pressure required for the forward motion of the form front with corresponding negative consequences for the quality of the tunnel lining, especially in loose earth and beneath the water table.

To maintain a satisfactory quality concrete lining the ensuing pressure fluctuations must be reduced. The concrete pressure in the form must be kept above the rising earth and water pressure and within a safe range.

OBJECTS OF THE INVENTION

It is an object of our invention to provide an improved apparatus and process for lining a tunnel with concrete which has none of the above mentioned disadvantages or difficulties.

It is also an object of our invention to provide an improved apparatus and process for lining a tunnel with concrete in which the magnitude of the damaging pressure fluctuations during concrete feed is reduced.

SUMMARY OF THE INVENTION

These objects and others which will become more readily apparent hereinafter are attained in accordance with our invention in a process for lining a tunnel with concrete behind a tunnel excavator having a form front advanced along with an excavator head in which the concrete is forced between the surrounding subterranean geological structure and the inner tunnel-lining form. There is simultaneous forward motion of the form front relative to the inner tunnel-lining form through the form front which is longitudinally movable relative to the shield and which rides sealingly on the outer surface of the inner tunnel-lining form and on the inner surface of the shield. The form front is moved exclusively by the force of the concrete pumped into the gap between the lining and excavated wall.

According to our invention our process includes measuring the friction forces between concrete sections of a predetermined length by drawing the form front forward relative to the stationary shield and the inner tunnel-lining form during an interruption in concrete feed.

These objects and others are also attained in an apparatus according to our invention for lining a tunnel with concrete comprising a form front and an associated inner tunnel-lining form in which the form front has an outer seal contacting on the inner surface of a shield and an inner seal contacting on the outer surface of the inner tunnel-lining form, is coupled to the shield by a movable concrete feed hose attached to a concrete pump and by an adjustable hydraulic spring device balancing the friction forces and a displacement measuring device which is an input element of a control device associated with the form front and the shield.

According to our invention our apparatus includes a hydraulic spring connected as a control element to the control device and the control device is equipped for storing an adjustment of the hydraulic spring device during measurement of the friction forces.

Our invention is based on experience which has been obtained during lining of tunnels with concrete. The changing friction forces acting on the moving form front during a concrete emplacement operation cannot be realistically estimated.

To guarantee a pressure stable concrete emplacement process with only minimal concrete pressure fluctuations it is thus required to determine the friction forces in concrete-feed interruption measuring intervals determined by the control process and the degree of precision required and to change a supporting or countervailing force acting continuously during feed of the concrete (during the following emplacement interval) so that the supporting force change corresponds to the change in the friction force. The supporting force is however directed opposite to the force generated by the concrete in advancing the form front direction. Adjusting the supporting to balance the friction force causes the form front to move forwardly in the tunnel digging direction exclusively by the concrete pressure force exceeding the supporting force, the arising friction forces being countered by the additional balancing forces applied to the system in its operation.

We can provide that for the determination of the friction forces the form front is drawn forward by such a distance that the form front itself is not detached from the portion of the concrete last fed in during the measurement interval interruption in concrete feed. This is possible in broken, i.e. yielding, ground without problems. It also gives a clear indication of the friction force, which is then equal to the force necessary to draw the form front forwardly.

The invention also makes it possible to determine the friction forces independently of each other along the periphery of the form front at several places. Correspondingly it is also possible to act on the form front with different balancing forces around its circumference.

With regard to the apparatus of our invention, the hydraulic spring device can comprise a plurality of parallel hydraulic piston-cylinder devices (angularly spaced about the axis of the annular form front) whose cylinder chambers facing away from the form front are connected by one hydraulic line with the a gas pressure hydraulic accumulator and whose cylinder chambers facing toward the form front are connected by another hydraulic line with a proportional pressure valve device.

The gas pressure hydraulic accumulator is provided for the spring action and the delivery of a definite supporting force, while the proportional pressure valve device together with the determination and adjustment of the forces balancing the friction forces is employed to generate the friction compensating force. Also the concrete pump can be connected to the control device as an additional control element.

BRIEF DESCRIPTION OF THE DRAWING

The above and other objects, features and advantages of our invention will become more readily apparent from the following description, reference being made to the accompanying highly diagrammatic drawing in which the sole FIGURE is a schematic drawing of an apparatus for carrying out the process for lining a tunnel with concrete according to our invention.

SPECIFIC DESCRIPTION

The sole FIGURE of the drawing shows an apparatus for lining a tunnel with concrete behind a tunnel excavator with a advanced along with an excavator head 1.

An annular form front 2 is used with the shield and has an inner annular seal 5 contacting on the outer surface of an inner annular tunnel-lining form 4 and an outer annular seal 3 contacting on the inner surface of the shield 1.

Concrete is forced through the form front 2 by a movable concrete feed hose 6 with a concrete pump 7. The concrete pumping means is only partially shown in the drawing.

The form front 2 is coupled to the shield 1 by an adjustable hydraulic spring device 8 balancing the friction forces. Moreover the form front 2 and the shield 1 are associated with a displacement measuring device 9 which is an input device for an electronic control device 10.

The above named hydraulic spring device 8 is connected as a control element to the control device 10 and the control device 10 is equipped to adjust the hydraulic spring device 8 on measurement of the friction forces.

The hydraulic spring device 8 comprises several parallel hydraulic piston-cylinder devices 11 of which only one is illustrated. The cylinder chamber 12 facing away from the form front 2 is connected by a hydraulic line 13 with a gas pressure hydraulic accumulator 14. This is designed so that practically the same pressure is always exerted on the piston of the hydraulic piston-cylinder device 11 independently of its position.

The cylinder chamber 15 of the hydraulic piston-cylinder device 11 facing the form front 2 is connected with hydraulic pump 18 by another hydraulic line 16 with a proportional pressure valve device 17.

With the help of the proportional pressure valve device 17 a constant hydraulic pressure can be maintained in the cylinder chamber. The concrete pump 7 is connected as an additional control element in the control device 10 to control the displacement depending on the concrete volume flow.

On deviation of the form front 2 relative to the shield 1 about the operating point $x_m$ in the direction $+x$ the concrete volume flow brought in through the form front 2 is reduced. On deviation from $x_m$ in the direction $-x$ the concrete volume flow is increased and with no deviation of the form front 2 the associated concrete volume flow is kept constant and/or unchanged. The operating point can be provided with a displacement tolerance.

The controller 10 can periodically interrupt pumping at 7 and through the use of valve 20 can cause, during this interruption in concrete feed, an advance of the form front so that the force supplied for this purpose can represent the friction force which is to be balanced during the next cycle of concrete feed.

During the friction measurement the form front 2 and the shield are stationary and the initially depressurized cylinder chamber 15 of the hydraulic piston-cylinder device 11 is continually acted on with an increasing pressure so that the hydraulic fluid of the hydraulic pump 19 is pumped into the cylinder chamber 15. The concrete flow control and the concrete feed is interrupted.

The supplied hydraulic fluid quantity is such that the form front 2 is drawn forward in the direction $+x$ after exceeding a certain pressure for advance of the form front 2. The measuring unit 9 registers a displacement from which the electronic control device 10 determines a speed change for the form front 2. This speed change is the signal for ending the hydraulic fluid feed. The resulting pressure is fed to the control device and if necessary is provided with a correction factor to be determined by calibration. The illustrated forces (supporting force $F_s$, concrete pressure force $F_b$, and the earth and water pressure force) are in balance. With a slight and sufficiently slow motion of the form front 2 the pressure conditions in the concrete chamber change only slightly, since the volume changes reflect a movement like that of an elastic membrane.

For the balancing process the proportional pressure valve device 17 is adjusted to the appropriate correct value and provides a measure of it. For the ideal case the balanced condition is as follows:

$$F\ stored(F_s)+F_r=F_b+F_k,$$

wherein F stored$(F_s)=F_b$ and $F_r=F_k$. For practical situations involving $F_{balance}$ a slight undercompensation of $F_{friction}$ is used. This means that the concrete pressure is set somewhat higher. If the concrete pressure now increases approximately a known amount $dF_b$, the form front 2 is set in motion in the direction of the concrete pressure force acting on it when the unbalanced force situation arises.

With a motion of the form front 2 in the direction +x relative to the inner tunnel-lining form 4 and with a higher form front speed relative to the shield cover 1 the forces checking the motion are approximately balanced.

In the normal case the balancing forces remain constant until a certain displacement, e.g. 20 cm, is provided with fresh concrete. The memory of control device 10 is equipped with all displacement information required to determine the concrete displacement. On attaining the provided displacement the balancing operation is interrupted and automatically a new friction force determination is performed.

As a safety measure and reliability reserve a higher concrete pressure than would be necessary according to the static boundary conditions and the slight undercompensation of the friction forces are calculated, so that an excess concrete pressure is used. The displacement of the form front 2 leads to a need for concrete volume flow control. The concrete volume flow is reduced.

From practical considerations the operating point $x_m$ can be provided with a tolerance range $x_1 > x_m > x_o$. If the form front is positioned inside this displacement range, the concrete volume flow remains constant.

In a motion of the form front 2 in the direction +x with stationary inner tunnel-lining form 4 and a reduced form front speed relative to the shield 1 a displacement in the direction −x is measured by the displacement measuring device 9. As a result the concrete volume flow is increased.

The increased concrete volume flow leads to a pressure increase in the annular space and subsequently to a motion of the form front 2 in the direction +x with a speed which is greater than that of the shield 1. The friction force acting on the form front 2 between the shield 1 and the form front 2 changes direction and under the circumstances also its magnitude.

To calculate thus the changes of the resulting friction force occurring, the balancing force is reduced until the relative speed between the form front 2 and the shield 1 is no longer negative. As a result of the deviation the concrete volume flow is increased. The increased concrete volume flow leads to a pressure increase on the form and subsequently to a motion of the form front 2 in the direction +x with a speed which is larger than that of the shield 1. An absence of relative motion between the shield 1 and the form front 2 does not lead to a substantial error compensation balancing as long as the direction of the friction forces between the inner tunnel-lining form 4 and the form front 2 as well as the shield 1 and the form front 2 maintain the same direction.

If the direction between the friction force between the shield 1 and the form front 2 changes, the total drive force is reduced and in the extreme case its direction can be reversed. The intervention of the control device 10 can include signaling of the operator. The operator can, if necessary, take suitable steps for "trouble shooting". With the form front 2 remaining stationary the control device 10 is designed so that the operation with a friction balancing can be immediately interrupted, i.e. the cylinder chamber 15 of the hydraulic piston-cylinder device 11 is vented. A new start for the balancing operation is possible after the trouble shooting operation.

Somewhat different from the described embodiment it is understandably also possible for detection and balancing of the friction forces to change the supporting pressure in the gas pressure hydraulic accumulator 14. Similarly it is possible to use a plurality of proportional pressure valve devices instead of the illustrated single proportional pressure valve device 17. For example each hydraulic piston-cylinder device 11 can be used with a single proportional pressure valve device which is the same as that indicated with reference character 17.

We claim:

1. A method of lining a tunnel with concrete, comprising the steps:

(a) advancing an excavating head in a subterranean structure to form a tunnel wall;

(b) moving with said head a shield lying generally along said wall and having an inner surface;

(c) spacedly juxtaposing with said wall and with said inner surface an outer surface of a tunnel-lining form so that said outer surface defines with said walla lining compartment;

(d) delimiting compartment with a form front sealingly engaging said outer surface and said inner surface, displaceable along said surfaces and connected to said head, and balancing friction forces between said form front and said surfaces and a countervailing force applied to said form front from said head;

(e) pumping concrete into said compartment at a rate such that the pressure of concrete pumped into said compartment is sufficient, because of balancing of said friction forces between said form front and said surfaces and said countervailing force, to displace said form front in a forward direction corresponding to direction of advance of said head substantially exclusively by said pressure;

(f) interrupting movement of said shield and pumping of concrete into said compartment;

(g) during interruption in the movement of said shield and pumping of concrete into said compartment, drawing said form front in said forward direction without pulling it away from the concrete in said compartment and measuring the force required to draw said form front in said forward direction as a measure of friction force between said form front and said surfaces; and (h) upon pumping of concrete into said compartment following interruption in step (f) and measurement of the friction force in step (g) and in response to the measurement of the friction force in step (g), increasing the rate of pumping of concrete into said compartment with retardation of said form front with respect to the advance of said shield and decreasing the rate of pumping of concrete into said compartment upon displacement of said form front faster than said shield in said forward direction.

2. The method defined in claim 1 wherein said friction forces are measured independently of each other along a periphery of said tunnel-lining form at a plurality of locations.

3. An apparatus for lining a tunnel with concrete, comprising:

a tunneling head advanced in a subterranean structure to form a tunnel wall, said head being provided with a shield lying generally along said wall and having an inner surface;

a tunnel-lining form spaced inwardly from said wall and extending therealong so that an outer surface of said tunnel-lining form defines with said wall a lining compartment into which concrete is pumped;

a form front disposed between said inner and outer surfaces, movable with said head and displaceable independently thereof along said surfaces in a direction of advance of said head, said form front having seals engaging said inner and outer surfaces with friction forces;

hydraulic means braced between said head and form front for applying countervailing force to said form front to balance said direction forces so that said form front is displaced in said direction substantially exclusively by the pressure of concrete pumped into said compartment;

means for measuring a force required to displace said form front in said direction upon termination of the pumping of concrete into said compartment and advance of said shield whereby the determined force is a measure of said friction forces; and means for adjusting said hydraulic means in response to the measurement of the friction forces so that upon further pumping of concrete into said compartment, said form front is displaced substantially exclusively by the pressure of the concrete pumped into said compartment.

4. The apparatus defined in claim 3 wherein said hydraulic means is a cylinder receiving a piston, said piston subdivides said cylinder into two chambers, one of said chambers being connected to a gas pressure hydraulic accumulator, the other of said chambers being connected to a source of hydraulic fluid provided with a proportional pressure valve.

5. The apparatus defined in claim 3, further comprising means for controlling a concrete pump for supplying concrete to said chamber in response to the measured friction forces.

* * * * *